United States Patent [19]

Groetsch, Jr. et al.

[11] Patent Number: 4,847,047

[45] Date of Patent: Jul. 11, 1989

[54] ENHANCEMENT OF TITANIUM-ALUMINUM ALLOYING BY ULTRASONIC TREATMENT

[75] Inventors: John G. Groetsch, Jr., Laurel; Timothy H. Elkins, Jr., Upper Marlboro; Charles A. Sorrell, Ijmasville, all of Md.

[73] Assignee: The United States of America as represented by the Secretary of the Interior, Washington, D.C.

[21] Appl. No.: 55,222

[22] Filed: May 29, 1987

[51] Int. Cl.[4] ..... C22C 21/00; C22C 1/00

[52] U.S. Cl. ..... 420/552; 75/68 R

[58] Field of Search ..... 75/68 R; 148/12.9; 266/233, 242

[56] References Cited

U.S. PATENT DOCUMENTS

| | | | |
|---|---|---|---|
| 1,921,998 | 8/1933 | Bonsack | 75/68 R |
| 2,654,670 | 10/1953 | Davis et al. | 75/68 R |
| 3,854,935 | 12/1974 | Snow | 75/68 R |
| 4,007,036 | 2/1977 | Gottschol et al. | 75/68 R |
| 4,373,950 | 2/1983 | Shingv et al. | 75/68 R |

FOREIGN PATENT DOCUMENTS

| | | | |
|---|---|---|---|
| 100683 | 6/1983 | Japan | 148/12.9 |

OTHER PUBLICATIONS

A. Crawford "Some Metallurgical Applications of Ultrasonics" from *Metallurgla* Mar. 1953, pp. 109–112 (148–12.9).

*Primary Examiner*—Kenneth J. Ramsey
*Attorney, Agent, or Firm*—E. Philip Koltos

[57] ABSTRACT

A method of increasing the dissolution rate of titanium or titanium alloys in molten aluminum is disclosed which comprises placing a titanium rod into molten aluminum and applying ultrasonic energy to the rod. The ultrasonic energy enhances the dissolution of the titanium in aluminum, homogenizes the molten alloy, and breaks up particles such as $TiAl_3$ which form into a layer at the surface of the melt. The application of ultrasonic energy increases the dissolution rate of solid titanium in molten aluminum, decreases the amount of time needed to achieve homogeneity, and results in a titanium-aluminum alloy with a reduction in grain size and improved properties.

10 Claims, No Drawings

ENHANCEMENT OF TITANIUM-ALUMINUM ALLOYING BY ULTRASONIC TREATMENT

FIELD OF THE INVENTION

The invention relates to a method of increasing the dissolution rate and homogeneity of titanium or titanium alloy in molten aluminum using ultrasonic energy.

BACKGROUND OF THE INVENTION

It is often desirable in metallurgy to combine certain elements for the purpose of producing an alloy of favorable properties. However, it is sometimes extremely difficult to dissolve the alloying elements quickly or reach complete homogeneity in a reasonable period of time. This is particularly the case with the alloying of aluminum with titanium. Titanium has been added to aluminum in order to reduce the grain size and improve the performance of cast aluminum products. Aluminum-titanium alloys often have improved mechanical properties, increased crack resistance, and enhanced surface uniformity, primarily because of the reduction in grain size. The titanium can be added to the aluminum in the form of elemental titanium, titanium salts, or any of a number of titanium alloys.

The major problem with regard to titanium-aluminum alloying is that a significant amount of the titanium forms into compounds such as $TiAl_3$ which grow out in dendritic patterns and form layers which must be further broken up. A mechanism for this incorporation of titanium into aluminum has been proposed in Machowick et al., *Journal of the Less Common Metals,* 1, 456–66 (1959). It was suggested that a very thin $TiAl_3$ layer forms and that $TiAl_3$ particles continue to grow out from this original layer. It was also concluded that this layer forms faster than the rate of diffusion of aluminum into titanium, and that the reaction is strictly a surface reaction. It is for this reason that adding titanium to aluminum by current methods involves significant delay in the casting procedure necessary for dissolution and diffusion of the titanium. It is thus desirable to develop a process to promote a fast and homogeneous alloying of titanium and aluminum.

Ultrasonic energy is a widely used tool in the field of metallurgy. Ultrasonic devices, such as those described in U.S. Pat. Nos. 2,820,263 and 3,162,908, are employed for a number of purposes in this industry. For instance, ultrasound treatment has been used to relieve residual stress in metallic welds, as described in U.S. Pat. No. 3,274,033, to refine the structure of superplastic zinc base eutectoids (U.S. Pat. No. 3,542,607), disperse inert particles in a molten matrix (Fairbanks, *IEEE Transactions on Sonics and Ultrasonics,* 14, 53–59 (1967)), and to reduce the grain size of stainless steels (Lane et al., *Transactions of the Metallurgical Society of the AIME,* 218, 985–990 (1960)). However, heretofore, ultrasonic energy has not been applied to enhance difficult metal alloying procedures such as the dissolution of titanium into aluminum. It would be of great value to develop a method by which ultrasonic energy could be used in order to promote the dissolution of titanium in the preparation of titanium-aluminum alloys.

SUMMARY OF THE INVENTION

It has been discovered that an enhancement of the reaction of titanium with aluminum can be achieved by placing solid elemental titanium or titanium alloy into molten aluminum and energizing with sufficient ultrasonic energy to break up the layers of $TiAl_3$ particles that form on the surface and drive the particles into the melt. This process results in an increase in the dissolution rate of the titanium, speeds up homogeneity of the alloy, and results in a cast aluminum alloy of reduced grain size.

DESCRIPTION OF THE INVENTION

According to the method of the present invention, the dissolution of titanium into aluminum is carried out by first placing solid titanium-containing material into an aluminum melt. The titanium can be introduced as elemental metal, or as any of a number of titanium salts or alloys. One such alloy suitable for use in the present invention is aluminum master alloy which typically comprises about 94% Al, 5% Ti, and 1% B. Suitable melt temperatures for the aluminum range from about 600° to 800° C.

It is preferred that the elemental titanium or titanium alloy placed into the molten aluminum is in the form of an elongated rod. When this rod is placed into the melt, it is necessary to contact it with a probe waveguide extending from a conventional ultrasonic energy source. The probe waveguide can be attached to the titanium rod before or after it has been placed in the melt. Preferably, the titanium rod is threaded and assembled into the probe waveguide before insertion so that the waveguide and rod act as a single unit.

Once in contact with the ultrasonic energy source and in place in the molten aluminum, the rod is then energized with ultrasonics at a level sufficient to enhance dissolution of the titanium. The level of ultrasonic agitation employed should also be sufficient to break up particles such as $TiAl_3$ that form into dendritic layers on the surface, and to drive the scattered particles back into the molten aluminum, further homogenizing the melt. As a result of this treatment, the overall dissolution of the titanium into the aluminum is increased, and homogeneity is achieved in a much shorter time than would normally occur under natural dissolution without ultrasound.

The ultrasonic energy used in the process of the present invention can be applied at any frequency provided certain conditions are met. One condition is that the length of the probe waveguide (or probe waveguide and tip when attached to each other) extending from the ultrasonic transducer must be a multiple of its resonant length. When this condition is met, the titanium rod can be regularly vibrated by the ultrasound, and the dissolution of the rod is more thorough. When probe waveguide length is not a multiple of resonance length, the vibration of the rod is irregular, and dissolution is slower at most frequencies. Probe waveguide resonant length is dependent on the operating frequency used and the velocity of sound of the construction material. The probe waveguide preferably comprises a steel rod. For typical operating frequencies, the resonance length of the steel waveguide is about 15 cm, and a waveguide of about 60 cm in length has been employed successfully. These probe waveguides had a diameter of about one inch or 2.54 cm. The waveguide can also be made of titanium or other suitable metals.

It is preferred that the operating frequency of this process be between 5 and 25 kHz, with 10–20 kHz particularly preferred. Input power level can vary between 300 and 1200 watts, with a level of about 1000 watts preferred. Normally, application of ultrasonic energy for around an hour is sufficient to achieve alloy homogeneity.

Experimentation of this application of ultrasonics has indicated that higher frequencies and higher power levels give resulting alloys with the greatest titanium content. In tests at 760° C. using 10 kHz and 1000 W for one hour, the final titanium content in a titanium-aluminum ingot was 0.5 weight percent, whereas at 20 kHz and 1000 W for one hour, final titanium content increased to 1.05 weight percent. At 500 W, application of ultrasound at a frequency of 10 kHz for 1 hour gave a final titanium content of 0.19 percent by weight, but at 20 kHz resulted in a final Ti content of 0.30 weight percent after one hour. As a comparison, in tests using an identical titanium rod and identical conditions, except for the ultrasonic treatment, the resulting ingot contained only 0.08 weight percent Ti after one hour. Thus, although the present invention can be used to increase Ti dissolution at any frequency and power level compatible with the user's equipment, increasing the frequency and power level will give even greater titanium concentration in the resultant alloys.

The process of the present invention also achieves homogeneity of the alloy metal in a shorter period of time than would normally be necessary, and at a higher final level of titanium content. Tests of homogeneity in an aluminum melt treated with heat but not ultrasonics indicate that it takes up to 5 hours to produce a consistent titanium level of 0.2 weight percent by natural dissolution. In the tests using the ultrasonic treatment of the present invention, a consistent titanium level was achieved in one hour, and at a higher level than that achieved in the natural dissolution process.

Still another advantage of the present invention is that the grain size of the treated aluminum alloys is smaller than that which occurs without ultrasonic treatment. Smaller grain size is of extreme benefit to the alloy size it results in increased ingot crack resistance, improved mechanical properties, and enhanced uniformity of surface finishes. In laboratory tests, aluminum treated by the ultrasound process of the invention had higher ASTM grain number, i.e., smaller grain sizes. The reduction of grain size in the aluminum after one hour of processing ranged from about 35 to 45 percent depending on the exact operating conditions. The grain size reduction has been observed to be greatest when elemental titanium is introduced into the molten aluminum.

The following examples are given to illustrate the present invention and are not to be construed as limiting the invention in any way.

EXAMPLE 1—Natural Dissolution

The dissolution of titanium into molten aluminum was studied in a small electrical resistance furnace. The furnace accepts graphite crucibles 3 cm in diameter and 12 cm long. Before each test the crucibles were filled with molten aluminum until the volume of aluminum was 100 $cm^3$. The melt's temperature was measured initially by a thermocouple outside the curcible and later calibrated with a direct reading probe. A pure titanium rod (CP grade 4) 0.635 cm in diameter and 15 cm long was immersed approximately 7–8 cm in molten aluminum 760° C. (1400° F.) for one hour. Optical sections revealed that a small intermetallic region approximately 0.01–0.02 cm formed away from the probe. This region contained $TiAl_3$ particles surrounded by an aluminum/titanium matrix. The titanium content in the matrix varied between 2–5 wt % Ti, dropping off rapidly as distance from the probe increased, as observed in Table 1.

TABLE 1

Titanium concentration versus distance for natural diffusion of 1 hour

| Distance, cm | Ti conc., wt %* |
|---|---|
| 0.0040 | 4.0 |
| 0.0085 | 5.0 |
| 0.015 | 3.0 |
| 0.024 | 2.4 |

* as determined by microprobe analysis, Bureau of Mines, Albany Research Center, Albany, Oregon Tests were conducted for longer times, up to 5 hours, and an increase in titanium concentration and melt homogeneity was observed. The concentration was observed to increase with the depth away from the probe after both the 1 hr and 5 hr trials, as can be observed in Table 2. This appears to occur because of the higher density of $TiAl_3$ particles which form in the melt as compared to the aluminum. As a result, the $TiAl_3$ tends to concentrate near the bottom of the crucible.

TABLE 2

Titanium concentration for natural dissolution

| Time | Ti concentration (wt %) @ | | | |
|---|---|---|---|---|
| (hr) | 2.54 cm | 5.08 cm | 7.62 cm | 10.16 cm |
| 1 | <0.05 | <0.05 | <0.05 | 0.08 |
| 5 | 0.19 | 0.17 | 0.22 | 0.39 |

EXAMPLE 2—Ultrasonic Dissolution

The molten aluminum-filled crucibles were prepared as described in Example 1, however, this time, dissolution of titanium was achieved through a two-piece ultrasonic probe design. This design employs a probe waveguide and a smaller threaded probe tip which can be assembled to act as one unit. The probe tip is a titanium rod (CP Grade 4) which is 0.635 cm in diameter and 15 cm long. The waveguide is made from a steel rod, and is 2.54 cm in diameter and 60 cm in length. The coupling of the components was good, and a coupling efficiency of over 90% was achieved. This design was necessary both as a cost saving measure and to prevent binding of the probe tip threads to the waveguide. The titanium probe tip was immersed approximately 7–8 cm into the molten aluminum (at 760° C.) and energized with ultrasonics at various frequencies and power levels for one hour.

Using ultrasonic energy, a quicker and more thorough dissolution of the titanium probe was obtained. This was evidenced in several different ways. The final shape of the probe tip differed between dissolution with ultrasonics and dissolution without. With ultrasonic energy, the probe tip loses its cylindrical shape and becomes more spherconic. Photomicrographs of probe tip cross sections illustrated the rounding of the tip, as well as the greater distribution of titanium into the melt. The rounding was also more pronounced the greater the power or wattage, indicating that the input power level greatly influences the dissolution rate. The micrographs also revealed that the needle-shaped $TiAl_3$ crystals form in a more random fashion when ultrasonic energy is used.

The ingot titanium concentration at various points in the melt was measured to determine how well ultrasonics was able to increase titanium distribution over what would be obtained by natural diffusion. The initial concentration of the aluminum was <0.002 wt % Ti. Using 10 khz and 20 khz for 1 hour at 500 and 1000 watts the final titanium concentration was measured. The maximum concentration for 10 khz was 0.55 wt % and 1.07 wt % for 20 khz. This maximum value remained fairly consistent throughout the melts. The titanium concentration distribution is shown in Table 3. These values are much higher than the level of titanium concentration obtained by natural dissolution.

TABLE 3

Titanium concentration after a 1 hour ultrasonic treatment

| Type test | Freq (khz) | Power (watts) | Ti conc. (wt %) @ 5.08 cm | 7.26 cm | 10.16 cm |
|---|---|---|---|---|---|
| Ultrasonic | 11.1 | 500 | 0.14 | 0.19 | 0.46 |
| | 11.1 | 1000 | 0.55 | 0.50 | 0.77 |
| | 18.0 | 500 | 0.20 | 0.31 | 2.90 |
| | 17.7 | 1000 | 0.63 | 1.07 | 1.02 |
| w/o ultrasonic | 0 | 0 | <0.05 | <0.05 | 0.08 |

Ultrasonic energy not only affected the titanium distribution, but the aluminum's final grain size as well. The ASTM grain size number, determined by the intercept method (see Hilliard, *Metals Progress*, May 1964, pp. 99–102), was greater for the ultrasonic tests. Increases in ASTM grain number translates into decreases in grain sizes. Grains were measured on horizontal cross section 7.62 cm into the melt. This depth was chosen because it was below the probe tip and well within the hot zone. The optical samples were first polished then etched with Poulton's Reagent (HCl, $HNO_3$, HF, $H_2O$) for a few seconds to increase the grain contrast. Photomicrographs of sections were taken and used to measure grain size. The data for grain size are presented in Table 4. The tests indicated that the ultrasonically treated alloy had a smaller grain size than the alloy which did not undergo ultrasonic treatment.

TABLE 4

Average grain size as affected by ultrasonics

| Type Test | Power (watts) | Freq (khz) | Avg Linear Intercept L (cm*10-12) | ASTM Grain Size No. (G*) |
|---|---|---|---|---|
| w/o Ultrasonics | 0 | 0 | 1.24 | 2.66 |
| | 0 | 0 | 1.57 | 1.98 |

TABLE 4-continued

Average grain size as affected by ultrasonics

| Type Test | Power (watts) | Freq (khz) | Avg Linear Intercept L (cm*10-12) | ASTM Grain Size No. (G*) |
|---|---|---|---|---|
| | 0 | 0 | 1.49 | 2.12 |
| w/Ultrasonics | 500 | 10 | .852 | 3.74 |
| | 500 | 10 | .876 | 3.66 |
| | 500 | 10 | .840 | 3.78 |
| | 1000 | 10 | .986 | 3.32 |
| | 1000 | 10 | 1.05 | 3.15 |
| | 1000 | 10 | 1.08 | 3.05 |
| | 500 | 18.0 | 1.15 | 2.88 |
| | 500 | 18.0 | 1.16 | 2.70 |
| | 500 | 18.0 | 1.15 | 2.88 |
| | 1000 | 17.7 | 1.27 | 2.59 |
| | 1000 | 17.7 | 1.22 | 2.70 |
| | 1000 | 17.7 | 1.29 | 2.55 |

$G^* = -10.00 + 6.64 \log (NM/L)$ M = magnification

What is claimed:

1. A method for promoting the dissolution of solid titanium in molten aluminum to form an aluminum-titanium alloy which comprises the steps of placing solid titanium-containing material into the molten aluminum and applying ultrasonic energy to the titanium-containing material at a level sufficient to promote dissolution of the titanium-containing material and result in the break up of titanium-containing particles which form into layers in the molten aluminum wherein the ultrasonic energy is applied directly to the solid titanium-containing material by means of a probe waveguide extending from an ultrasonic energy source.

2. A method according to claim 1 wherein the titanium-containing material comprises elemental titanium.

3. A method according to claim 1 wherein the titanium-containing material comprises a titanium alloy.

4. A method according to claim 3 wherein the titanium alloy comprises about 94% aluminum, 5% titanium, and 1% boron.

5. A method according to claim 1 wherein the titanium-containing particles are comprised of $TiAl_3$.

6. A method according to claim 1 wherein the length of the probe waveguide is a multiple of its resonant length.

7. A method according to claim 1 wherein the probe waveguide comprise a steel rod.

8. A method according to claim 1 wherein the solid titanium-containing material comprises an elongate rod.

9. A method according to claim 1 wherein the ultrasonic energy is applied at a frequency of 5–25 kHz.

10. A method according to claim 1 wherein the ultrasonic energy is applied with an input power level of 300–1200 watts.

* * * * *